US007032632B2

(12) United States Patent
Shingle

(10) Patent No.: US 7,032,632 B2
(45) Date of Patent: Apr. 25, 2006

(54) MEASURING AND DISPENSING CLOSURE

(75) Inventor: John M. Shingle, Perrysburg, OH (US)

(73) Assignee: Owens-Illinois Prescription Products Inc., Toledo, OH (US)

( * ) Notice: Subject to any disclaimer, the term of this patent is extended or adjusted under 35 U.S.C. 154(b) by 0 days.

(21) Appl. No.: 10/952,145

(22) Filed: Sep. 27, 2004

(65) Prior Publication Data

US 2006/0065326 A1 Mar. 30, 2006

(51) Int. Cl.
*B65B 1/04* (2006.01)

(52) U.S. Cl. ..... 141/381; 141/112; 222/158

(58) Field of Classification Search ..... 141/98, 141/112, 322, 381; 401/126–129; 222/424.5, 222/454–456
See application file for complete search history.

(56) References Cited

U.S. PATENT DOCUMENTS 202,268 A 4/1878 Keller
2,485,303 A * 10/1949 Louise ..... 366/247
2,619,088 A 11/1952 Saffir
2,762,526 A 9/1956 Gilmour
2,804,103 A * 8/1957 Wall ..... 141/381
4,192,360 A 3/1980 Rodriquez
4,219,283 A * 8/1980 Buckley et al. ..... 401/129
4,226,456 A 10/1980 Barnett
4,566,508 A 1/1986 Bowyer
5,149,506 A 9/1992 Skiba et al.
5,586,676 A 12/1996 Lynd
5,642,689 A 7/1997 Harvey
5,682,931 A 11/1997 Mouchmouchian
5,881,894 A 3/1999 Gargano
6,422,426 B1 * 7/2002 Robbins et al. ..... 222/158
6,578,725 B1 6/2003 Delman et al.

FOREIGN PATENT DOCUMENTS

GB 2142322 A 1/1985

* cited by examiner

*Primary Examiner*—Timothy L. Maust

(57) ABSTRACT

A dispensing closure has an integral measuring device and spoon applicator. The closure has an internal thread on a skirt for fitting onto a container finish. The closure has a tubular measuring device depending from the base wall within the radial confines of the skirt and ending at a spoon applicator for ease of oral administration.

1 Claim, 1 Drawing Sheet

MEASURING AND DISPENSING CLOSURE

The field of this invention relates to a measuring and dispensing closure for a container.

BACKGROUND OF THE INVENTION

Many liquids, such as cough syrups and other liquid medications, need to be administered at a proper dosage for most beneficial effect. As such, a spoon or other measuring device, such as an eyedropper, is often required. Eyedroppers are suitable for small doses such as a few drops. Measuring spoons are also commonly used. Specialized measuring spoons, often called dosing spoons, have been developed which have a tube like handle that, when stood upright, can receive and measure liquid. The open end has a spoon shaped extension to provide easy oral administration of the liquid as the spoon is tipped downwardly while containing liquid.

In order to reduce the dispensing of unmeasured amounts of medication, pharmaceutical companies have attempted to provide a measuring spoon, dosing spoon or measuring cup such that the delivery applicator and the measuring device are in the same implement that accompanies the bottle of medication. However, in spite of previous attempts of pharmaceutical manufacturers to assure that the measuring spoon or cup on top of the bottle closure stays with the medicine bottle, the measuring cup or spoon commonly became separated or misplaced. The person in need of medication is then tempted to take an unmeasured amount straight from the bottle.

Previous dosing devices integrated with the closure have either been unwieldy for oral administration of the medicine or became messy by unwanted dripping of medicine as the devices exit the bottle from a position submerged in the medicine within the bottle.

What is needed is a measuring device and dispensing spoon combination that is integrated with a closure for a container. What is also needed is a measuring and dispensing device that has a spoon section for ease of oral administration and provides for automatic wiping of the spoon as it exits the bottle to reduce undesirable dripping.

SUMMARY OF THE INVENTION

In accordance with one aspect of the invention, a measuring and dispensing closure has a base wall with a skirt for securing the closure to a container finish, a closed wall extending from the base wall within the skirt and defining with the base wall an interior cavity with an open distal end, and an arcuate wall integrally extending from an edge of the closed wall for dispensing product from the interior cavity.

Preferably, the skirt has an internal thread for securing to a container finish. The arcuate wall is desirably coaxially centered about the center of rotation of the base wall. The arcuate wall also has a radius of curvature at least as great as the radius of the container finish opening. In an exemplary preferred embodiment, the arcuate wall is tapered toward a distal end to form a spoon shaped applicator. In the exemplary preferred embodiment, the base wall is flat or has another appropriate shape to allow the measuring and dispensing closure to be self-standing in a stable position.

In accordance with another aspect of the invention, a one-piece integrally molded plastic member has a closure, a measuring section and an application section. Preferably, the closure has a base wall with a skirt for securing the closure to a container finish, and an annular wall extending from said base wall within and spaced from the skirt. The annular wall has a closed end at the base wall and an open end spaced from the base wall to form an interior cavity for the measuring section. An open arcuate wall section extends from the annular wall and axially away from the base wall to forming the applicator section for dispensing product from the interior cavity. Preferably, the applicator section is spoon shaped and has an exterior wall section axially spaced from internal sliding engagement with a container finish when the closure is received to the container finish. The exterior wall section is positioned under the container finish to abut and be wiped by the container finish as the spoon section is pulled vertically upward through the finish opening from within the bottle.

BRIEF DESCRIPTION OF THE DRAWINGS

Reference now is made to the accompanying drawings in which.

DETAILED DESCRIPTION OF PREFERRED EMBODIMENTS

Figure 1:
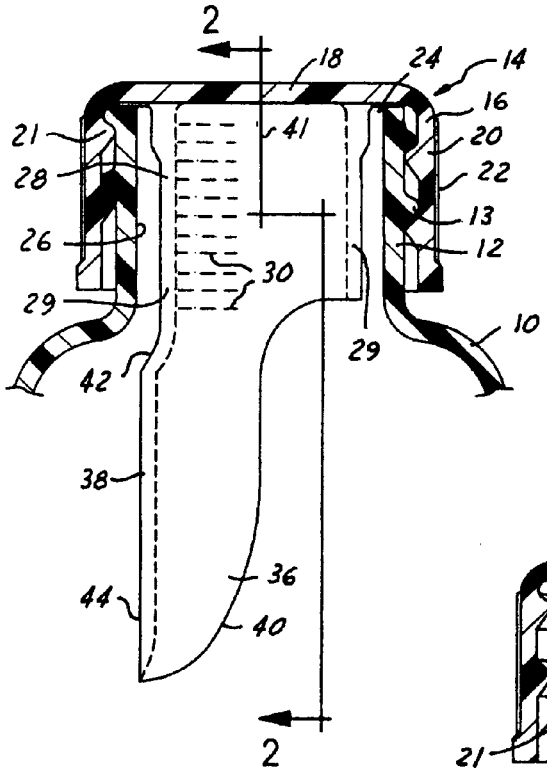
FIG. 1 is a fragmentary and segmented view of one embodiment according to the invention.
Figure 2:
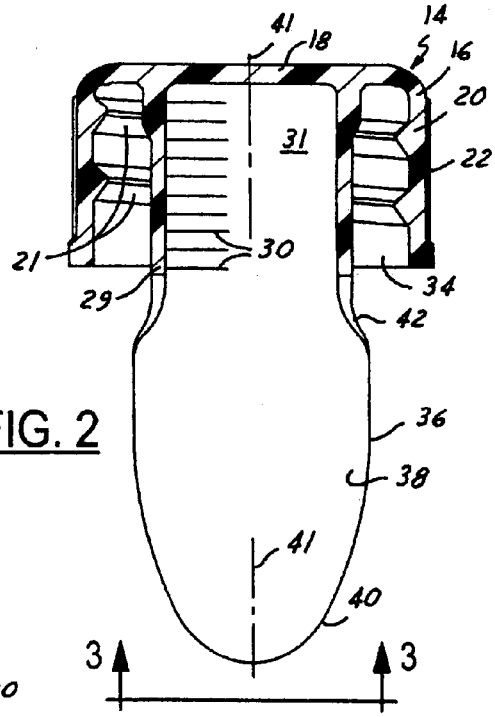
FIG. 2 is a cross-sectional view taken along lines 2—2 shown in FIG. 2 of the closure, measuring device and spoon member.
Figure 3:
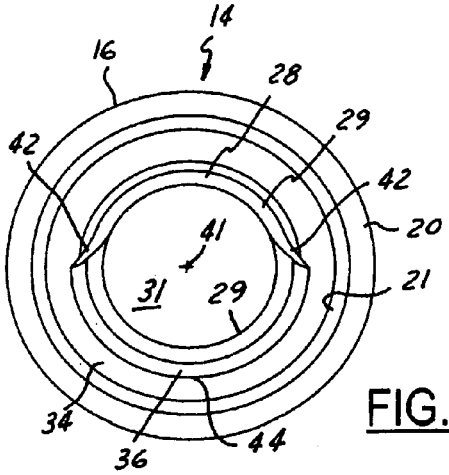
FIG. 3 is a bottom plan view taken along lines 3—3 shown in FIG. 2.

Referring now to FIG. 1, a container such as a medicine bottle 10 has a cylindrical finish 12 with one or more external threads or thread segments 13. The finish 12 has an opening or mouth 24 defined by an interior wall surface 26 with a dimensioned radius. The finish 12 seats a dispensing closure 14 that has an integral finish closure shell 16, a measurement device 28 and a spoon shaped applicator 36. Closure 14 has its shell 16 formed by a base wall 18 and an internally threaded skirt 20 with internal threads or thread segments 21. The exterior surface of skirt 20 may have serrations 22 for enhancing a hand grip thereon. The skirt 20 and finish 12 may also incorporate a known and suitable child resistant mechanism (not shown). The base wall 18 may have a conventional internal seal lip (not shown) if desired to abut and seal with the end of finish 12. The base wall 12 preferably is flat to allow the dispensing closure 14 to be self standing when in an upside down position from that shown in the Figures. The top surface of the base wall 18 may have other shaped configuration to provide for a self standing stable position. The closure 14 may be made from a commercially available plastic in common use for closures approved for food and medicinal items.

A measuring device 28 extends from the base wall 18, and protrudes through the opening 24 in finish 12 and into the bottle 10. The measuring device 28 preferably is cylindrical in shape, with a closed cylindrical wall 29 defining a cavity 31 therein that is capable of retaining liquid when in an upright position. Measuring indicia 30 preferably are marked on the interior or exterior side of wall 29. The indicia may be printed thereon, or embossed or debossed therein.

A spoon shaped applicator 36 has an arcuate wall section 38 that rigidly and axially extends from the cylindrical wall 29. The arcuate wall section 38 is approximately 1800 span, which forms a wide opening from cavity 31 onto the spoon shaped application 36. The arcuate wall has its radial center coaligned with the center rotational axis 41 of the base wall. The applicator 36 also has a tapered edge 40 with a reduced arcuate span to provide the spoon shape and allow ease of oral administration of liquid. The wall 38 is laterally displaced from the wall 29 to form a step section 42 where the arcuate span is approximately 180°. The step section 42 extends laterally a sufficient distance that the wall 38 is positioned under finish 12 such that, when the skirt is unthreaded from the finish 12 and the closure assembly 14 is lifted up, the backside of wall 38 will be wiped by the interior wall 26. The spoon is desirably shaped such that its radius is the same or slightly greater than the radius of internal wall 26, such that the entire backside—i.e. exterior section of wall 38—can be wiped as it is pulled out of the opening 24. The wall 38 may flex during the wiping action to conform to the radius of the opening 26 and assure a complete wipe of the back side of wall 38 which greatly reduces any dripping from the spoon shaped applicator 36.

Once the bottle is opened and the closure 14 is pulled out, the spoon shaped applicator 36 may be tipped or canted upward to receive the liquid as it is poured from the bottle and help direct the liquid into the now upright interior cavity 31 up to the desired or appropriate measuring indicator 30 to provide a proper dosage.

After the measuring operation is complete, the member 14 may store the liquid in the cavity 31, and may be placed on a table or other flat surface and be stationary with support from the flat base wall 12. Upon application to the recipient, the spoon shaped applicator 36 is then tipped downwardly into the mouth of the recipient whereby the liquid is drained from the cavity 31 over the spoon wall 38 and its tapered section 40 to be administered to the recipient.

The closure 14 can be easily washed and then threaded back onto the bottle. The finish 12 extends into the annular gap 34 formed between the skirt 20 and cylindrical wall 29 on the closure is fastened onto finish 12 to close the bottle 10.

In this fashion, a medicine bottle has a readily stored measuring device and spoon applicator that is stored in the bottle and is integral with the closure to assure that it is always available with the medicine.

Variations and modifications are possible without departing from the scope and spirit of the present invention as defined by the appended claims.

The invention claimed is:

1. A measuring and dispensing closure that includes:

a one-piece body of integrally molded plastic construction, said body having:

a base wall, a cylindrical skirt extending from said base wall, means on said skirt for securing said closure to a container finish, a continuous annular wall integrally extending from said base wall within and spaced from said skirt, said annular wall and said base wall forming a cup having a closed end at said base wall and an open end spaced from said base wall, and a spoon-shaped applicator integrally extends from said annular wall axially away from said base wall for dispensing product from said cup within said annular wall wherein said annular wall has measurement indicia for measuring product placed within said cup formed by said annular wall and said base wall.

* * * * *